US006415703B1

(12) United States Patent
Raisio

(10) Patent No.: US 6,415,703 B1
(45) Date of Patent: Jul. 9, 2002

(54) METHOD FOR CONTROLLING THE MOTION VELOCITY OF A HYDRAULICALLY DRIVEN MACHINE, A DRIVE SYSTEM FOR A HYDRAULICALLY DRIVEN MACHINE

(75) Inventor: Reijo Raisio, Turku (FI)

(73) Assignee: Multilift Oy, Raisio (FI)

( * ) Notice: Subject to any disclaimer, the term of this patent is extended or adjusted under 35 U.S.C. 154(b) by 0 days.

(21) Appl. No.: 09/600,599

(22) PCT Filed: Jan. 22, 1998

(86) PCT No.: PCT/FI98/00052

§ 371 (c)(1),
(2), (4) Date: Sep. 6, 2000

(87) PCT Pub. No.: WO99/37928

PCT Pub. Date: Jul. 29, 1999

(51) Int. Cl.[7] ..... F15B 13/04
(52) U.S. Cl. ..... 91/31; 91/6
(58) Field of Search ..... 91/31, 6

(56) References Cited

U.S. PATENT DOCUMENTS

| | | | | | |
|---|---|---|---|---|---|
| 2,780,204 | A | * | 2/1957 | Barley | 91/6 |
| 3,038,449 | A | * | 6/1962 | Murphy et al. | 91/6 |
| 3,945,299 | A | * | 3/1976 | Fritz et al. | 91/31 |
| 4,506,867 | A | | 3/1985 | LeGlue | |
| 4,537,220 | A | | 8/1985 | Anderson | |
| 4,642,986 | A | | 2/1987 | Chatelin | |
| 4,831,825 | A | * | 5/1989 | Jeschke | 91/444 |
| 4,989,495 | A | * | 2/1991 | Gabellini et al. | 91/6 |
| 5,261,232 | A | | 11/1993 | Maffini et al. | 60/429 |

FOREIGN PATENT DOCUMENTS

| | | |
|---|---|---|
| DE | 2608988 | 9/1976 |
| DE | 4010973 | 10/1980 |
| DE | 4129508 | 3/1993 |
| EP | 0082676 | 6/1983 |
| SE | 376788 | 3/1973 |

* cited by examiner

*Primary Examiner*—F. Daniel Lopez
*Assistant Examiner*—Igor Kershteyn
(74) *Attorney, Agent, or Firm*—Burns, Doane, Swecker & Mathis, LLP

(57) ABSTRACT

The present invention concerns a method for controlling the speed of motion of a hydraulically operated machine, an operating system and a control device of the machine. The flow line (3) of the medium from the pump (2) to the machine (1) is divided into two branches (10, 11). By means of a valve (8), the second branch (11) can be set to feed medium either to the machine (1) or to return the medium to the tank (4) of the pump. Such a flow is led to the second valve (8), that at a speed of rotation of the pump lower than the highest speed of rotation, the difference between the flow supplied by the pump and the flow through the second branch produces the desired slowest speed on motion of the device. When the valve (8) is set to return the medium to the tank (4) of the pump, the flow from the pump (2) is adjusted by changing the speed of rotation of the pump.

13 Claims, 1 Drawing Sheet

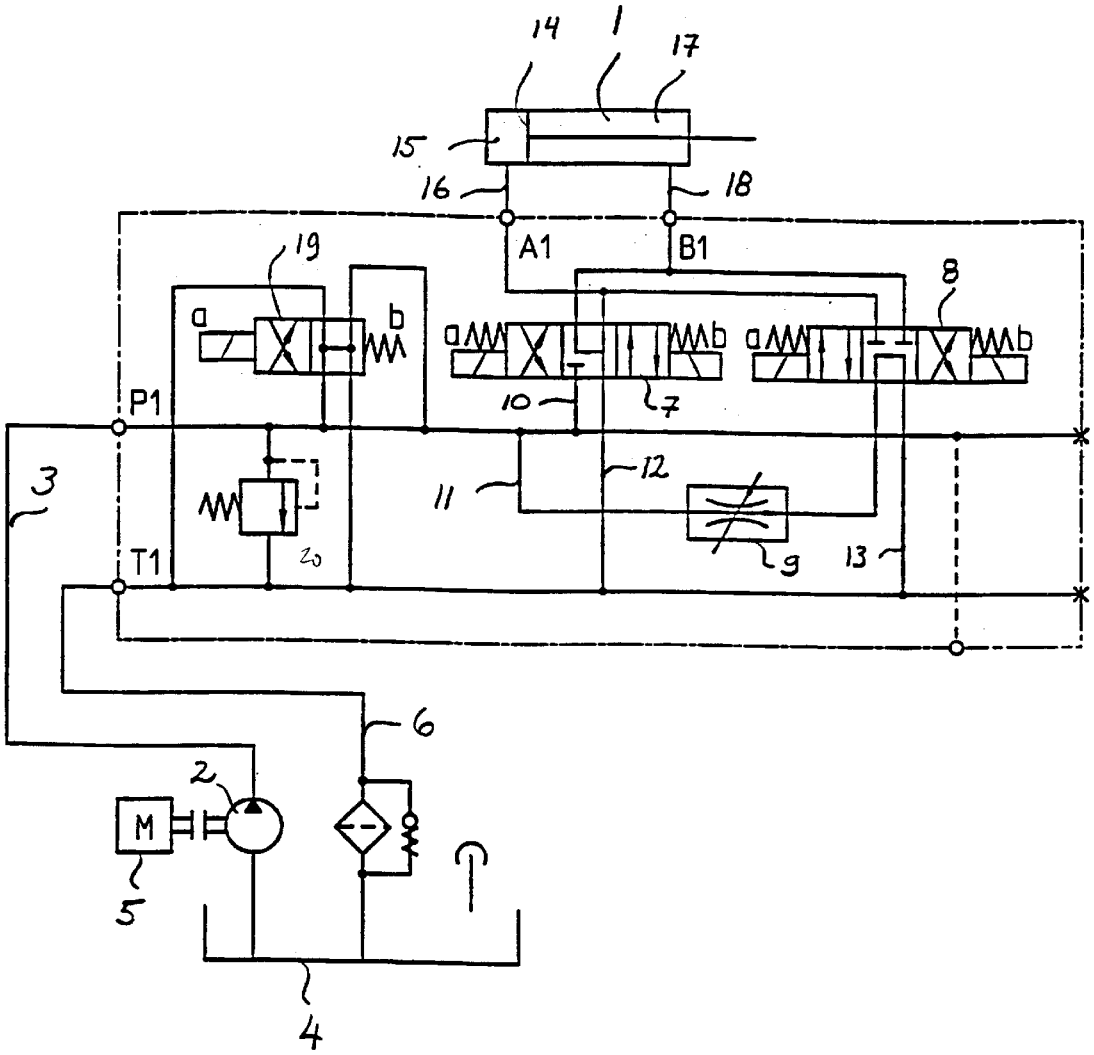
14
1
17
15
16
18
A1
B1
19
8
a
b
a
b
a
b
P1
10
7
3
11
12
T1
20
9
13
6
2
M
5
4

METHOD FOR CONTROLLING THE MOTION VELOCITY OF A HYDRAULICALLY DRIVEN MACHINE, A DRIVE SYSTEM FOR A HYDRAULICALLY DRIVEN MACHINE

TECHNICAL FIELD

The present invention concerns a method for controlling the speed of motion of a hydraulically driven machine, an operating system, and a control device of a hydraulically driven machine.

BACKGROUND ART

Hydraulic systems are known in the art, where the speed of motion of a hydraulically driven machine can be adjusted for different purposes.

Publication DE 30 10 973 discloses a control system, where the positions of the valve and the feed of the hydraulic oil to the machine to be driven are adjusted by means of a control cam. Depending on the valve position, three different feeding speeds and speeds of the machine can be provided.

Publication DE 26 08 988 discloses a system, where by using different flow resistances, the motion of the hydraulic piston operating the machine can be slowed down, e.g. when lowering a heavy load.

In the system in accordance with publication SE 376 788, the acceleration and speed of a hydraulic actuator of a pressure casting machine is controlled so that a desired speed profile can be exactly repeated. There, the main control valve is controlled by means of an auxiliary valve.

Publication DE 41 29 508 concerns a system provided with two pumps, wherein the speed of rotation of a hydraulic motor is adjusted. With a small load of the motor, only one pump is used. When necessary, the motor is also supplied with a part of the feed volume of the other pump.

DISCLOSURE OF INVENTION

The object of the present invention is to provide a control system, where the speed of a hydraulically operated device, when necessary, can be proportionally controlled.

By means of the present invention, the speed of e.g. a hydraulic cylinder-piston device of a vehicle's loading device can be controlled, when necessary, in any position of the piston. During a slow precision drive, the speed can be controlled by changing the speed of rotation of the pump.

Although the valves used in the system are on-off valves, the required controlling of the speed can be provided proportionally by means of the device in connection with starting and ending of a motion.

An on-off valve means a valve that either opens or closes certain flow channels, but by means of which the flow cannot be continuously controlled during the operation, like with an actual control valve.

A simple pump can be used in the system, whereby the flow produced by it is controlled by changing its speed of rotation. There is no need of any variable capacity pump with a complicated construction, where the change of flow is provided by changing the position of the pistons, while the speed of rotation remains the same.

BRIEF DESCRIPTION OF THE DRAWING

The invention and its details will now be described in more detail, with reference to the enclosed drawing illustrating schematically a system in accordance with the invention and the control unit therein.

MODE FOR CARRYING OUT OF THE INVENTION

In a system in accordance with the invention, the machine to be operated is e.g. a hydraulic cylinder-piston device 1 for operating a loading device of a vehicle. The system is driven by a hydraulic pump 2 that, rotated by a motor 5, feeds hydraulic fluid through a feeding line 3 from a tank 4. The fluid returns to the tank through a return line 6.

Feed to the cylinder 1 is controlled by means of a control unit in accordance with the invention. The control unit comprises a primary control valve 7 and a secondary control valve 8 as well as a flow control valve 9. From the feeding line 3, a line 10 branches out to the primary control valve 7, and a line 11 going via the flow control valve 9 to the secondary control valve 8. The primary control valve 7 is connected to the return line 6 via a line 12. The secondary control valve 8 is connected to the return line via a line 13.

The primary control valve 7 has three positions:

a) feed to the cylinder 1, to the first side of a piston 14, through a line 16 connected to chambers 15, and return from the second side of the piston from a chamber 17 through a line 18;

b) closed position, in other words, connection from the feeding line 10 is closed, connection from the lines 16 and 18 to the line 12 leading to the return line 6 is open;

c) feed and return contrary to the position a).

Also the secondary control valve 8 has three positions:

a) the same as the position a) of the primary control valve 7;

b) the line 11 is connected to the line 13 that is connected to the return line 6, connection to the lines 16 and 18 is closed;

c) the same as the position c) of the primary control valve 7.

Before the control unit in the system, between the feeding line 3 and the return line 6, there is a free circulation valve 19 and a safety valve 20, opening from the feeding line to the return line, if the pressure in the feeding line exceeds a certain limit. The valve 19 has two positions. When both control valves 7 and 8 are in their basic positions, in other words in the above mentioned positions b), and the pump is switched on, the oil is led through the valve 19 back to the tank in order to avoid unnecessary loading of the pump. When the valves 7 and/or 8 are set to the operating position, the valve 19 is set to position a, whereby the feed from the pump will be led to the valves 7, 8 and 9.

The system in accordance with the present invention operates as follows:

The flow of the flow control valve 9 is adjusted slightly below the lower limit production of the pump 2 or, if desired, even to the same or slightly higher. By means of the flow control valve, the flow is set as desired, but it is not necessary to use the valve for a continuous control during the operation.

The movement procedure is always started with a low speed of rotation of the pump. The secondary control valve 8 is set to position b), that is, to return all the flow coming to the valve 8 from the line 11, to the return line 6 through the line 13. By switching then the primary control valve 7 on, either to the position a) or to the position c), in other words, to feed to one or the other side of the piston 14, the feed to the machine to the cylinder 1 is very small or even=0, that is, the difference between the feed volume $Q_P$ and the volume $Q_V$ flowing through the flow control valve 9.

If the flow control valve 9 has been set according to the lower limit production of the pump or above that, the machine will not start before the speed of rotation of the pump is increased, because the whole feed volume goes through the valve 9 and returns through the valve 8 to the return line 6. The speed of rotation of the pump can be normally increased about to a double compared to the lower limit.

By means of this primary circulation, the desired speed control can be provided by the device in connection with the start and the end of the motion. The operation can be made proportional although the control valves used are of on-off type.

During so called large movements, when no precision drive is required, in addition to the primary control valve 7, also the secondary valve 8 is switched on either in the position a) or in the position c). Then the oil led in the primary phase through the flow control valve 9 back to the tank 5 will be led to the machine 1, to either side of the piston. Thus, the flow from the pump 2 can be totally utilized.

Stopping or slowing down of the machine is provided so that first, the secondary control valve 8 is switched off, to the position b), and after that the movement is slowed down by decreasing the speed of rotation of the pump. Then the speed of the device slows down while the flow through the line 11 returns to the return line 6. Thus, the eventually required precision drive or slowing down in order to stop the movement can be effected.

The term "flow" used above, as well as in the claims, means the value:volume unit of medium per time unit.

What is claimed is:

1. A method for adjusting speed of a hydraulically operated machine, comprising:

in a non-operating mode of the machine, operating a pump to pump hydraulic medium through a flow line at a first flow rate, setting a first valve, the first valve being connected to the flow line by a first branch and being connected to a part of the machine by at least a first line and being connected to a return line, so that a path between the first branch and the first line is closed, and setting a second valve, the second valve being connected to the flow line by a second branch and being connected to the part of the machine by at least the first line and being connected to the return line, so that a path between the second branch and the return line is open; and in an operating mode of the machine, setting the first valve so that the path between the first branch and the first line is open, setting the second valve so that the path between the second branch and the return line is open, and adjusting a flow rate through the pump to adjust a speed of the machine.

2. The method as set forth in claim 1, comprising controlling flow through the second branch to be equal to the first flow rate.

3. The method as set forth in claim 2, wherein flow through the second branch is controlled by a flow control valve.

4. The method as set forth in claim 1, comprising, in a second operating mode of the machine, setting the first valve so that the path between the first branch and the first line is open, and setting the second valve so that the path between the second branch and the first line is open.

5. The method as set forth in claim 4, wherein the first valve is connected to a second part of the machine by a second line and, in the operating mode, the first valve is set so that a connection between the second line and the return line is open.

6. The method as set forth in claim 4, comprising slowing the machine from the second operating mode of the machine by setting the second valve so that the path between the second branch and the first line is closed.

7. The method as set forth in claim 4, comprising controlling flow through the second branch to be equal to the first flow rate, and slowing the machine from the second operating mode of the machine to the non-operating mode of the machine by first setting the second valve so that the path between the second branch and the first line is closed and then adjusting the flow rate through the pump to the first flow rate.

8. The method as set forth in claim 1, comprising, in the non-operating mode, setting the first valve so that a connection between the first line and the return line is open.

9. The method as set forth in claim 1, wherein the first valve is connected to a second part of the machine by a second line and, in the operating mode, the first valve is set so that a connection between the second line and the return line is open.

10. An operating system for a hydraulically operated machine, comprising:

a pump for hydraulic fluid, the pump being operable at different speeds;

a flow line leading from the pump;

a first branch connected to the flow line;

a first valve connected to the flow line by the first branch;

a first line connecting the first valve to a first part of the machine;

the first valve being adapted to open and close a connection between the first branch and the first line;

a second branch connected to the flow line;

a second valve connected to the flow line by the second branch and to the first line; and a return line connected to the second valve, the second valve being adapted to open and close a connection between the second branch and the first line and being adapted to open and close a connection between the second branch and the return line, wherein the first valve is controllable such that, in a non-operating mode of the machine, the first valve is set to close the connection between the first branch and the first line and, in an operating mode, the first valve is set to open the connection between the first branch and the first line and a speed of the machine is adjusted by adjusting a speed of the pump.

11. The operating system as set forth in claim 10, wherein a lowest operating speed of the pump causes a first flow rate and the second branch includes a flow control valve adapted to control flow in the second branch to be at least equal to the first flow rate.

12. The operating system as set forth in claim 11, wherein the first and second valves are controllable such that, in a second operating mode, the first valve is set to open the connection between the first branch and the first line and the second valve is set to open the connection between the second branch and the first line.

13. The operating system as set forth in claim 10, wherein the first and second valves are controllable such that, in a second operating mode, the first valve is set to open the connection between the first branch and the first line and the second valve is set to open the connection between the second branch and the first line.

* * * * *